US009176517B2

(12) United States Patent
Pelletier et al.

(10) Patent No.: US 9,176,517 B2
(45) Date of Patent: Nov. 3, 2015

(54) METHOD FOR ASSEMBLING A PEDAL ASSEMBLY

(75) Inventors: Jon Pelletier, Conroe, TX (US); Mark McGuyer, Conroe, TX (US)

(73) Assignee: KONGSBERG AUTOMOTIVE AS, Kongsberg (NO)

( * ) Notice: Subject to any disclaimer, the term of this patent is extended or adjusted under 35 U.S.C. 154(b) by 325 days.

(21) Appl. No.: 13/994,981

(22) PCT Filed: Dec. 16, 2010

(86) PCT No.: PCT/EP2010/007708

§ 371 (c)(1),
(2), (4) Date: Aug. 1, 2013

(87) PCT Pub. No.: WO2012/079607

PCT Pub. Date: Jun. 21, 2012

(65) Prior Publication Data

US 2013/0326856 A1 Dec. 12, 2013

(51) Int. Cl.
*G05G 1/46* (2008.04)
*G05G 1/38* (2008.04)

(52) U.S. Cl.
CPC .. *G05G 1/46* (2013.01); *G05G 1/38* (2013.01); *Y10T 29/49826* (2015.01)

(58) Field of Classification Search
CPC ..... Y10T 29/49893; Y10T 29/49904; Y10T 74/2168; Y10T 74/20888
See application file for complete search history.

(56) References Cited

U.S. PATENT DOCUMENTS

| | | | |
|---|---|---|---|
| 5,241,936 | A | 9/1993 | Byler et al. |
| 6,523,433 | B1 | 2/2003 | Staker |
| 6,718,845 | B2 | 4/2004 | Menzies |
| 6,725,741 | B2 | 4/2004 | Menzies |
| 2004/0149070 | A1 | 8/2004 | Solta |
| 2008/0276749 | A1 | 11/2008 | Stewart et al. |
| 2008/0283372 | A1 | 11/2008 | Lee |

FOREIGN PATENT DOCUMENTS

| | | | |
|---|---|---|---|
| DE | 102006032576 | A1 | 11/2007 |
| EP | 1428714 | A1 | 6/2004 |
| GB | 2187541 | A | 9/1987 |

OTHER PUBLICATIONS

English language abstract and figures for EP1428714 extracted from the espacenet.com database on Aug. 8, 2013, 4 pages.
English language abstract and machine-assisted translation for DE102006032576 extracted from the espacenet.com database on Aug. 8, 2013, 11 pages.
International Search Report for Application No. PCT/EP2010/007708 dated Aug. 19, 2011, 4 pages.

*Primary Examiner* — David Bryant
*Assistant Examiner* — Amanda Meneghini
(74) *Attorney, Agent, or Firm* — Howard & Howard Attorneys PLLC

(57) ABSTRACT

The present invention relates to a method for assembling a pedal assembly for a motor vehicle, the method including:—pivotally mounting a pedal lever (10) by inserting a cylindrical end portion (12) thereof through an opening in a first housing part (1) to be at least partially received in a complementary shaped first cylindrical bearing space portion (7) provided in the first housing part.

10 Claims, 9 Drawing Sheets

METHOD FOR ASSEMBLING A PEDAL ASSEMBLY

Figure 1:
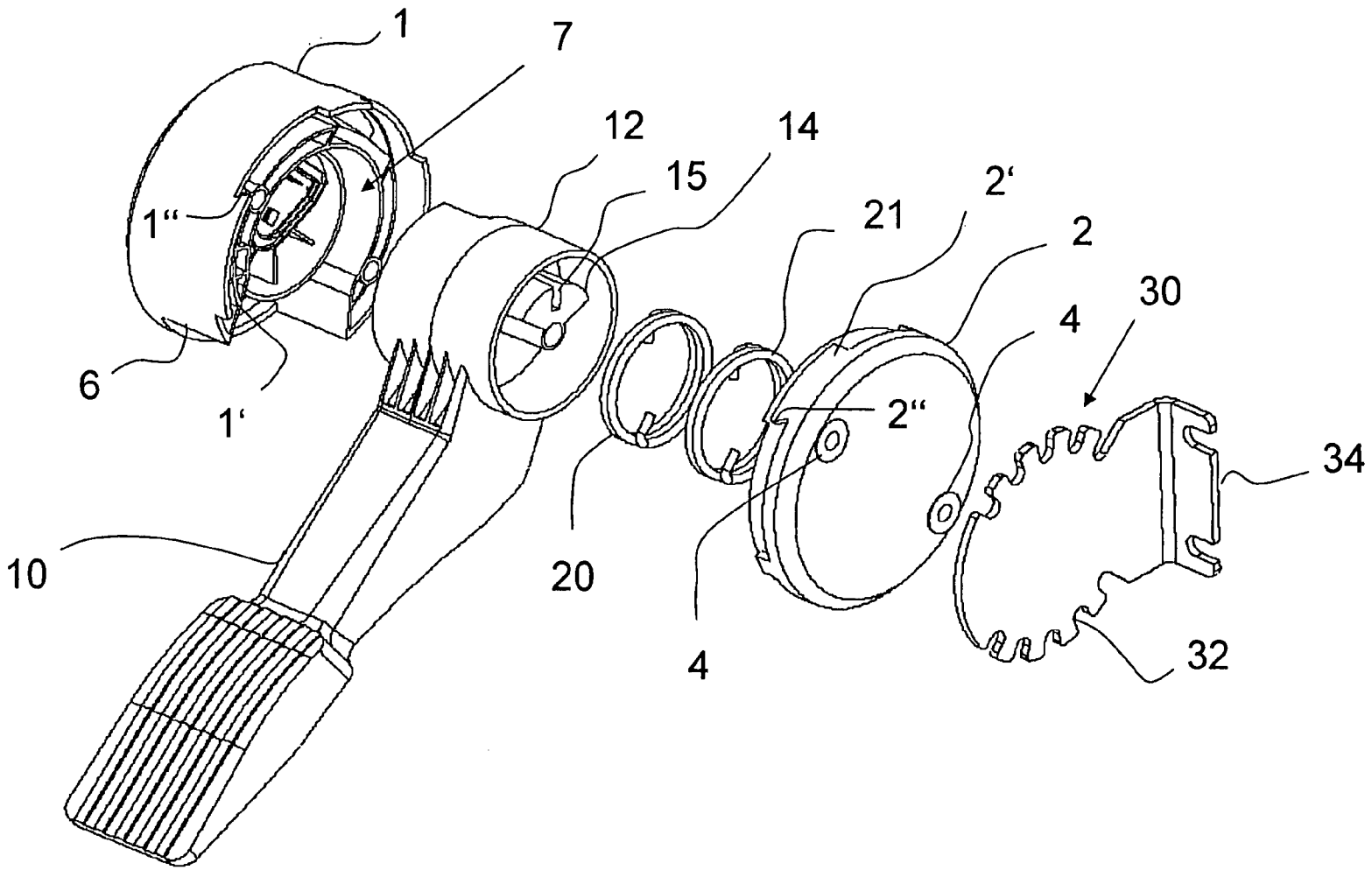

The subject patent application claims priority to and all the benefits of International Patent Application No. PCT/EP2010/007708, filed on Dec. 16, 2010. The disclosure of International Patent Application No. PCT/EP2010/007708 is incorporated herein by reference in its entirety.

The present invention relates to a method for assembling a pedal assembly for a motor vehicle, the method including:

pivotally mounting a pedal lever by inserting a cylindrical end portion thereof through an opening in a first housing part to be at least partially received in a complementary shaped first cylindrical bearing space portion provided in the first housing part, which first housing part comprises a stop surface against which the pedal lever abuts in a rest position, providing a spring mechanism exerting a bias force on the pedal lever to urge it to its rest position, and applying a second housing part to close the opening of the first housing part and connecting the first and second housing parts.

Such a method for making a pedal assembly is for example known from U.S. 2008/0283372 A1. The housing comprises three main parts, two of them forming the major part of the housing and the third forming a lid or cover part which may be fixed to the remaining housing by a plurality of screws to be screwed into holes in the cover housing part and in threaded holes in the remaining housing part. The pedal lever comprises a cylindrical end portion which is placed in a bearing space portion within the first housing part and received therein for pivotal movement. In addition a spring mechanism is provided which includes two compression springs which are mounted in an extra space within the housing and which act on an extension part on the cylindrical end portion opposite to the pedal lever to urge it into a rest position in abutment against a stop surface. This extra space needed for the spring mechanism requires the housing to be rather large and does not allow for a compact design of the assembly. The assembly process is complicated and time consuming, in particular due to the need to insert several screws for closing the housing. Furthermore, the housing is provided with extension flanges which comprise holes through which screws are intended to be inserted for mounting the housing in a vehicle cabin. Since the projecting flanges are an integral part of the housing, the pedal assembly housing may only be fixed in a vehicle cabin in an orientation predetermined by the projecting flanges.

Many other pedal assemblies are known which comprise a central shaft on which the pedal lever is journalled for pivotal movement. This type of pedal assembly is even more complicated since it requires an extra solid shaft to be mounted in the housing in order to provide a bearing for the pedal lever.

It is an object of the present invention to provide a method for assembling a pedal assembly which allows to assemble the pedal assembly using a small number of components and which thus provides a time and cost efficient assembly process.

This object is solved by a method for assembling a pedal assembly as defined in claim 1, preferred embodiments for the invention are set out in the dependent claims.

According to the present invention a torsional coil spring is attached with one of its end portions to the cylindrical end portion of the pedal lever. A second end portion of the torsional coil spring is attached to the second housing part, and the second housing part is applied to the first housing part to close the first housing part and cover the cylindrical end portion. Thereafter the second housing part is rotated with respect to the first housing part to establish a spring tension in the torsional coil spring which generates the desired bias force urging the pedal lever to its rest position against the stop surface. Finally the first and second housing parts are connected to maintain the tensioned state of the torsional coil spring.

In a preferred embodiment the step of connecting the first and second housing parts involves that the second housing part is rotated with respect to the first housing part beyond the point of the intended locking position in which the desired bias force is established by the tension of the spring mechanism. Then the first and second housing parts are moved further towards each other in the direction of the axis of the rotational movement such that mating connection means on the first and second housing parts are located opposite to each other in rotational direction. Finally, the first and second housing parts are allowed to rotate back biased by the force of the spring mechanisms such that the connection means come into mating engagement and are held in this engaged state in the intended locking position of the first and second housing parts by the bias force of the spring mechanism. In this preferred embodiment no fasteners or any additional components are needed to connect the two housing parts. Rather, the bias force of the spring mechanism, which is anyhow needed for holding the pedal lever normally in its rest position and for returning it thereto after it has been pressed down, is utilized for the further purpose to hold the second housing part biased for rotation against the first housing part in a configuration in which it is in interlocking or mating engagement with the first housing part. Since the pedal lever is resting on the stop surface of the first housing part, the spring force acting between a pedal lever and the second housing part leads to a reaction force on the second housing part that is in opposite direction to the force exerted on the pedal lever and thereby on the first housing part. Thus, first and second housing parts are biased for rotational movement against each other. This is utilized to hold the connection means in mutual engagement and the housing and pedal lever in a preassembled state.

Furthermore, the spring mechanism is brought to the desired tensioned state by a step of the assembly method. In addition, the torsional coil spring mechanism may be rather flat as a spiral spring so that between the cylindrical end portion and the second housing part no extra space for the spring mechanism is needed. Further, the spring mechanism may be received in a recess of the cylindrical end portion.

In particular it has to be noted that the pedal assembly may be brought to the assembled state with very few assembly steps. First, the pedal lever is inserted with its cylindrical end portion into a bearing space portion in the first housing part. A torsional spring is provided and is engaged with one of its ends on the cylindrical end portion of the pedal lever (either before or after it placed in the bearing space portion), and with its other end with the second housing part. Thereafter, the second housing part is turned or rotated in order to generate the biased state of the spring and to bring the first and second housing parts into a position in which the connection means may come into an interlocking engagement by a rotational movement biased by the torsional coil spring. In this state the pedal assembly is ready for shipment to the car manufacturer where it can be mounted in a vehicle using a bracket provided with the pre-assembled housing and pedal lever.

The connecting means of the housing parts may be formed by projections or elongations extending the walls of the first and second housing part. The projections are disposed in complementary portions of the circumference of the first and second housing parts if the housing parts are in their intended locking position with respect to each other. At least one edge of a projection of the first housing part and its associated edge of the complementary projection of the second housing part are formed as sloping protrusions which fit into each other such that said rotational movement of the second housing part relative to the first housing part in opposite rotational direction to the direction of the rotation returning the pedal lever to its rest position causes an interlocking or mating engagement of said sloping protrusions.

The leading edge of a protrusion of the second housing part, which is leading during said rotational movement of the second housing part, is inclined in the direction of said rotational movement, whereas the associated edge of the protrusion of the first housing part is inclined in a complementary manner so that these inclined edges come into fitting engagement with each other upon said rotational movement of the second housing part. These protrusions can also be seen as oppositely directed hook portions which come into mating engagement when being rotated towards each other. It is obvious for the skilled person that there are many other designs of connecting means which are capable of coming into engagement upon relative rotational movement of the second housing part with respect to the first housing part. In principle, also very simple or short thread turns on both housing part can be utilized for this purpose. Also, radial projections from one housing part can be arranged with respect to recesses in the other housing part such that they are capable of coming into fitting engagement upon said rotational movement of the second housing part with respect to the first housing part.

In a preferred embodiment of the method the step of connecting the first and second housing parts involves rotating the second housing part with respect to the first housing part to the intended locking position in which the desired bias force is established by the tension of the spring mechanism and moving the first and second housing parts towards each other in the direction of the axis of the rotational movement to bring latch projections on one of the housing parts into engagement with locking recesses on the other housing part to thereby establish an interlocking engagement between the first and second housing parts.

In an alternative embodiment the connection of the first and second housing parts may also be achieved by applying fasteners, such as screws, to fix the two housing parts with respect to each other.

The cylindrical end portion of the pedal lever may comprise recesses which open into openings on both of its end faces. One of these recesses in the cylindrical end portion of the pedal lever may for example receive a magnet which is fixed therein. A non-contact magnetic sensor unit is attached to the first housing part such that the output signals of the magnetic sensor unit are indicative of the turning position of the pedal lever with respect to the first housing part. The recess opening to the other end face of the cylindrical end portion of the pedal lever may receive part of the spring mechanism.

The non-contact magnetic sensor which may be in the form of a printed circuit board and may be attached to one of the inner walls inside the first housing part and sealed there by a sealing covering.

The spring mechanism may comprise at least one torsional coil spring having two projecting end portions. For attaching an end portion of the torsional coil spring a mounting body may be disposed in a recess of the cylindrical end portion facing the second housing part. This mounting body may be provided with a slot extending in the radial direction of the cylindrical end portion of the pedal lever. The slot of the mounting body is arranged to receive one projecting end portion of the torsional coil spring to be hold therein, and a further slot is provided on the inner surface of the second housing part to receive the other end portion of the torsional coil spring. In this arrangement the torsional coil spring is essentially received in the recess of the cylindrical end portion of the pedal lever.

In other embodiments in which the cylindrical end portion of the pedal lever is dimensioned with a smaller outer diameter a torsional coil spring may be located radially outside of the cylindrical end portion of the pedal lever and coaxial thereto, whereas further wall structures extend from the end portion of the lever arm and partially surround the torsional coil spring and allow to attach one end portion thereof on the wall structures for connecting it to the pedal lever, while the other end portion is again fixed to the second housing part by inserting the other end portion of the torsional coil spring in a slot provided on the inner surface of the second housing part. This has the advantage that manufacturing tolerances of the cylindrical end portion of the pedal lever and the bearing space in the first housing part are less critical.

In a preferred embodiment a bracket for fixing the housing in a vehicle cabin may be provided which comprises a base portion, which is adapted to be mounted on one of the housing parts, and a projecting portion extending therefrom. The projecting portion comprises at its remote end means which allow fixation on a vehicle cabin structure. The housing comprises at least two threaded holes for receiving screws. The base portion of the bracket is rotationally symmetric in that it comprises a plurality of openings arranged on the base portion such that a pair of opposing opening may selectively be brought into alignment with the two threaded holes. By providing such plurality of openings in the base part of the bracket it is possible to select a rotational position of the bracket with respect to the housing by selecting the openings of the bracket which are brought into alignment with the threaded holes of the housing and through which the screws are inserted to be screwed to the housing to thereby mount the bracket in a desired angular orientation with respect to the housing.

Figure 5:
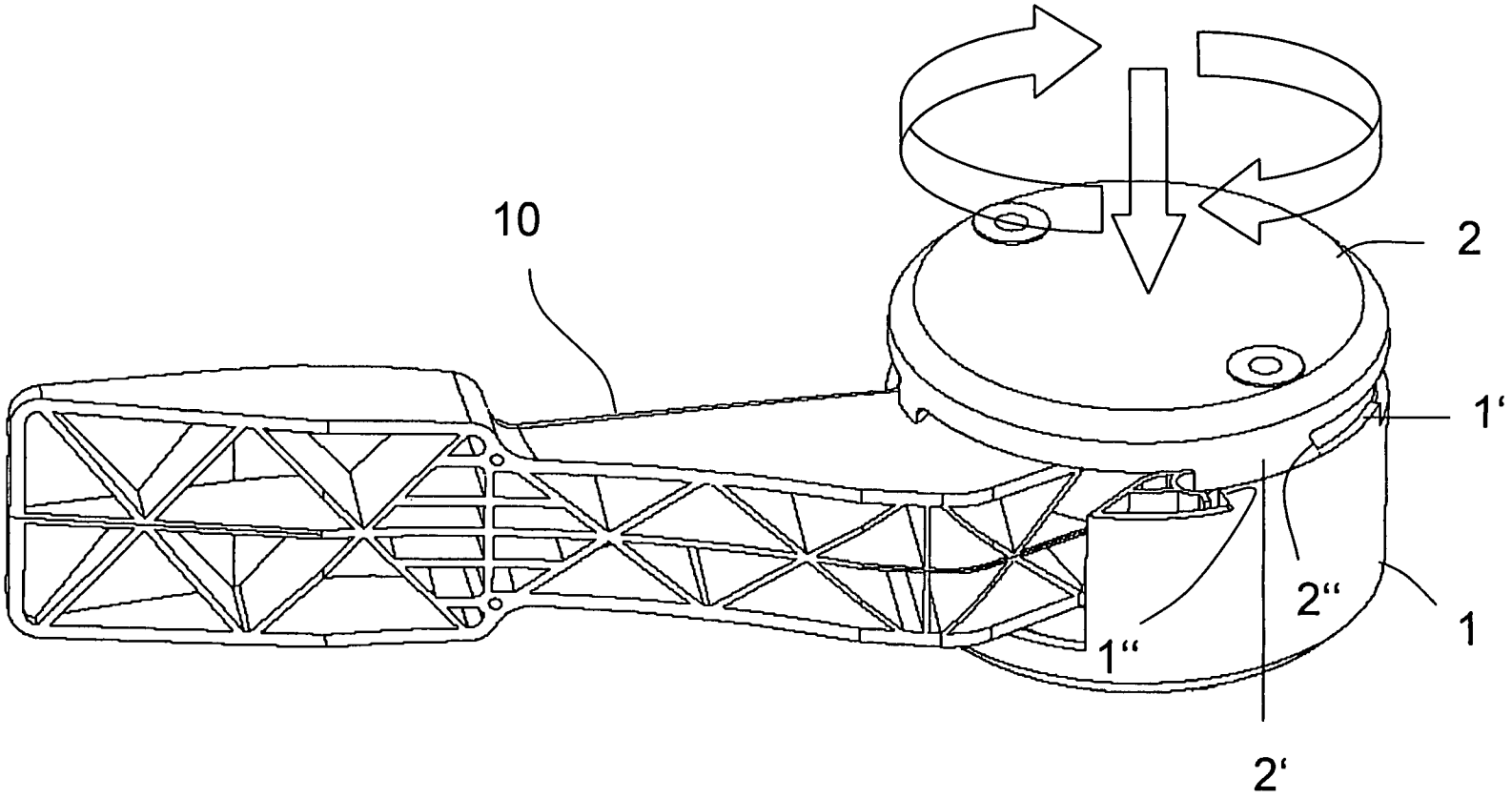
Figure 6:
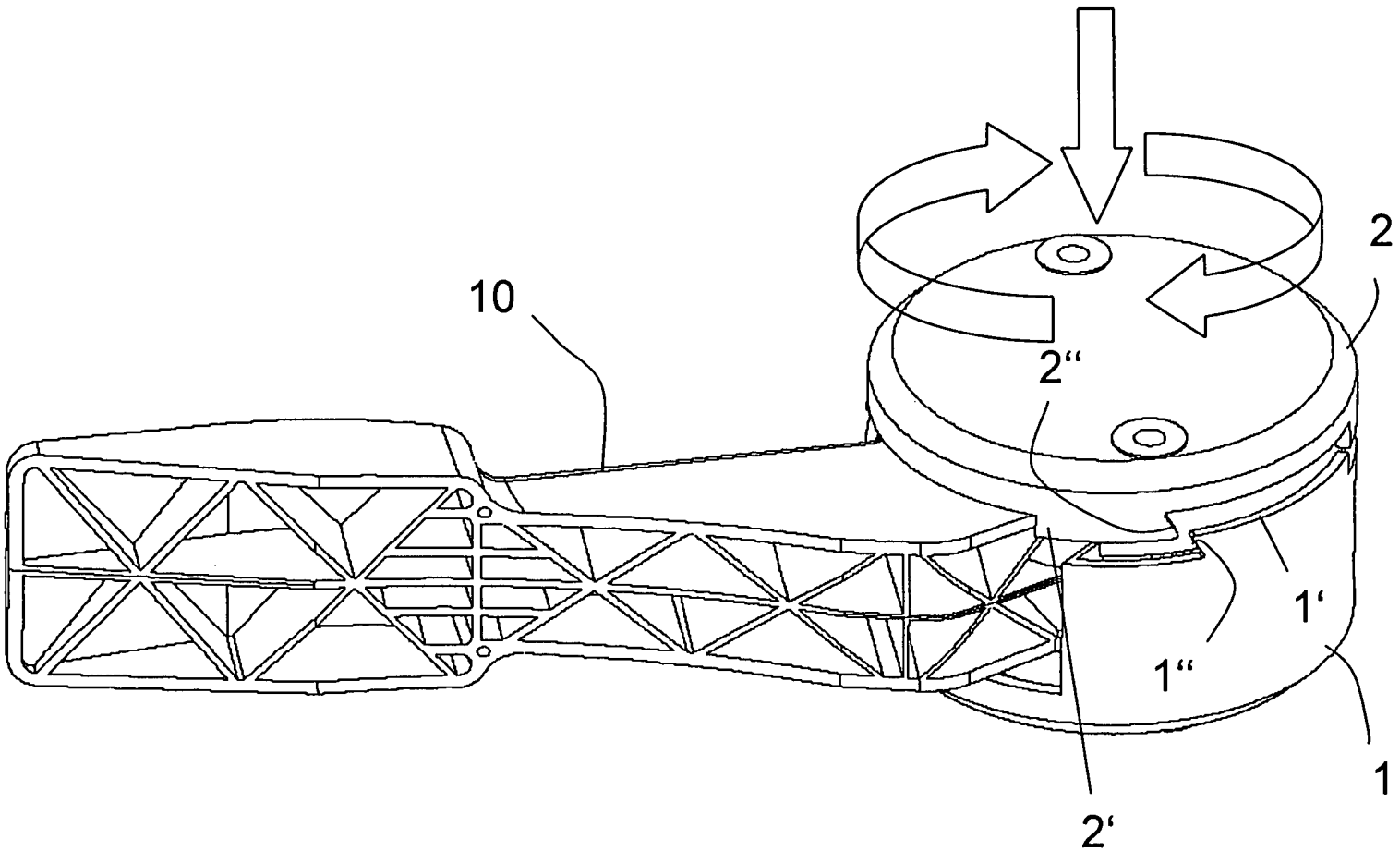
Figure 7:
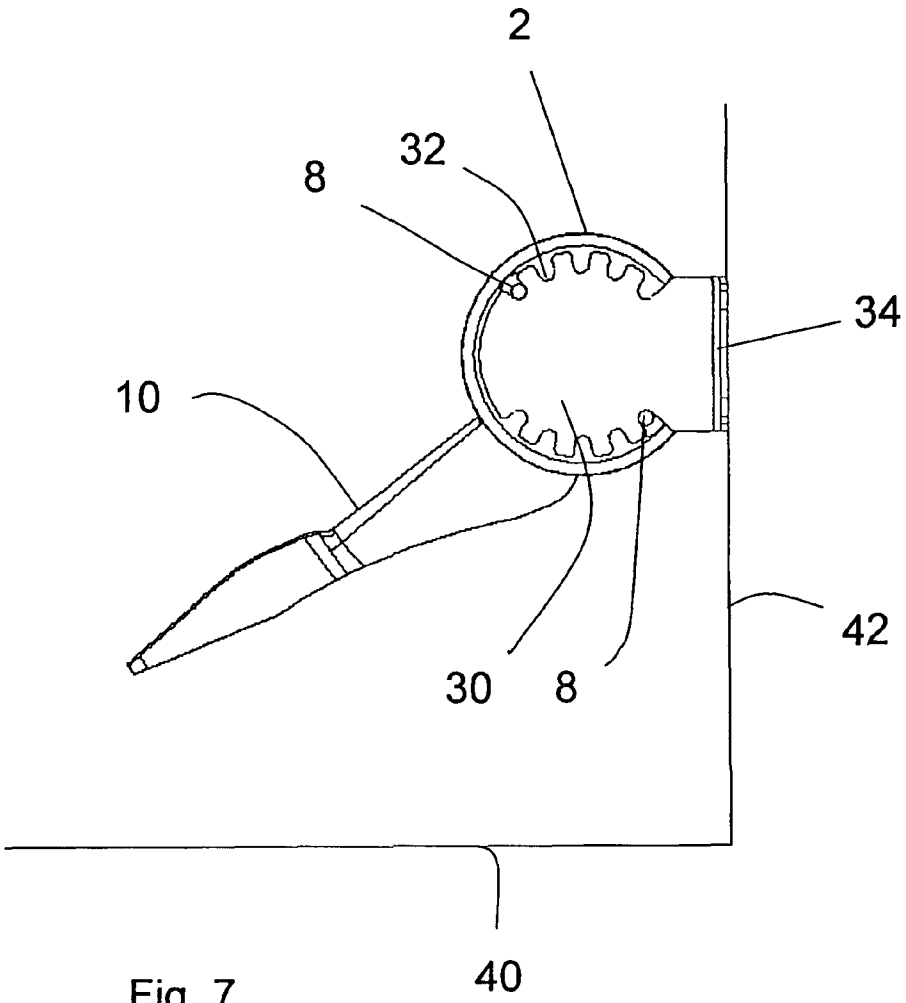
Figure 8:
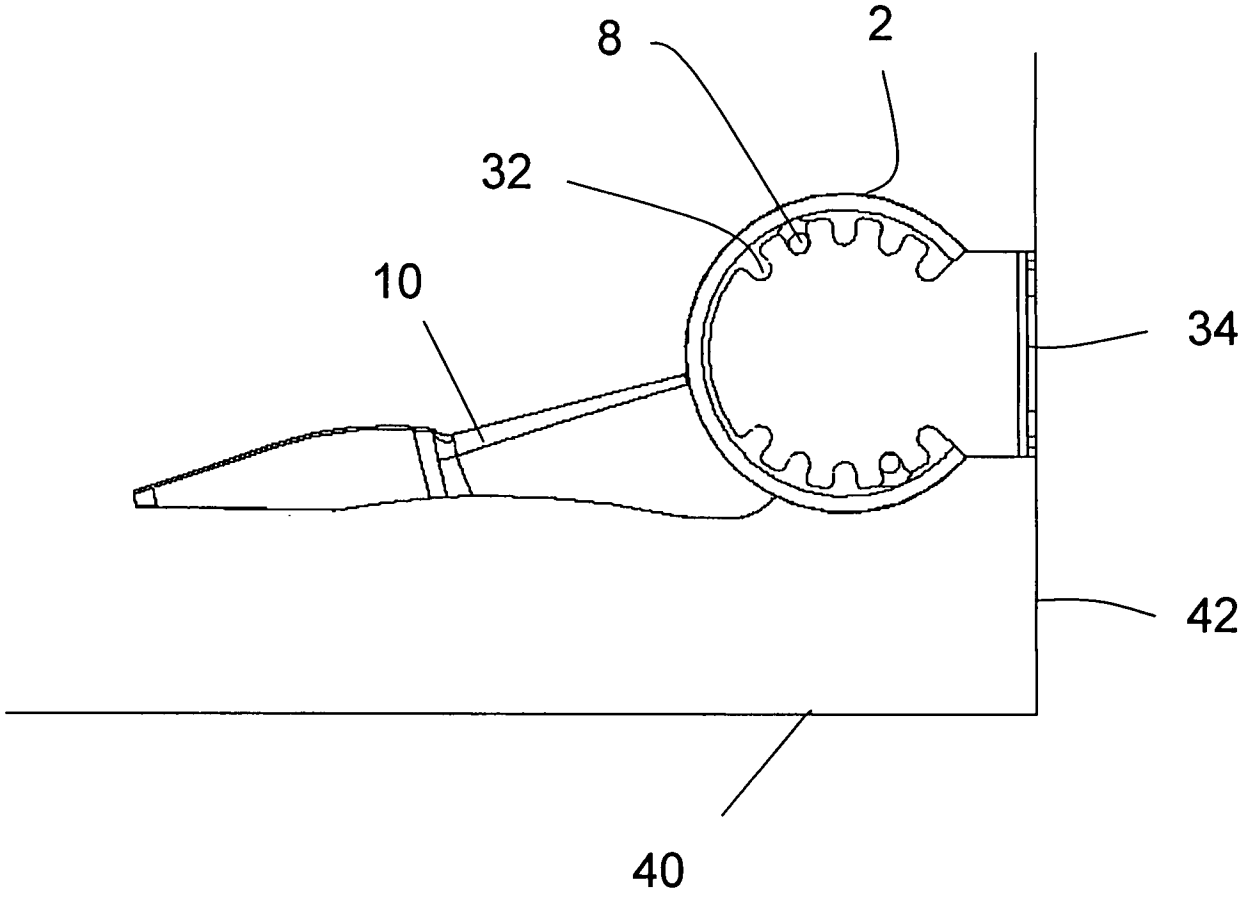
Figure 9:
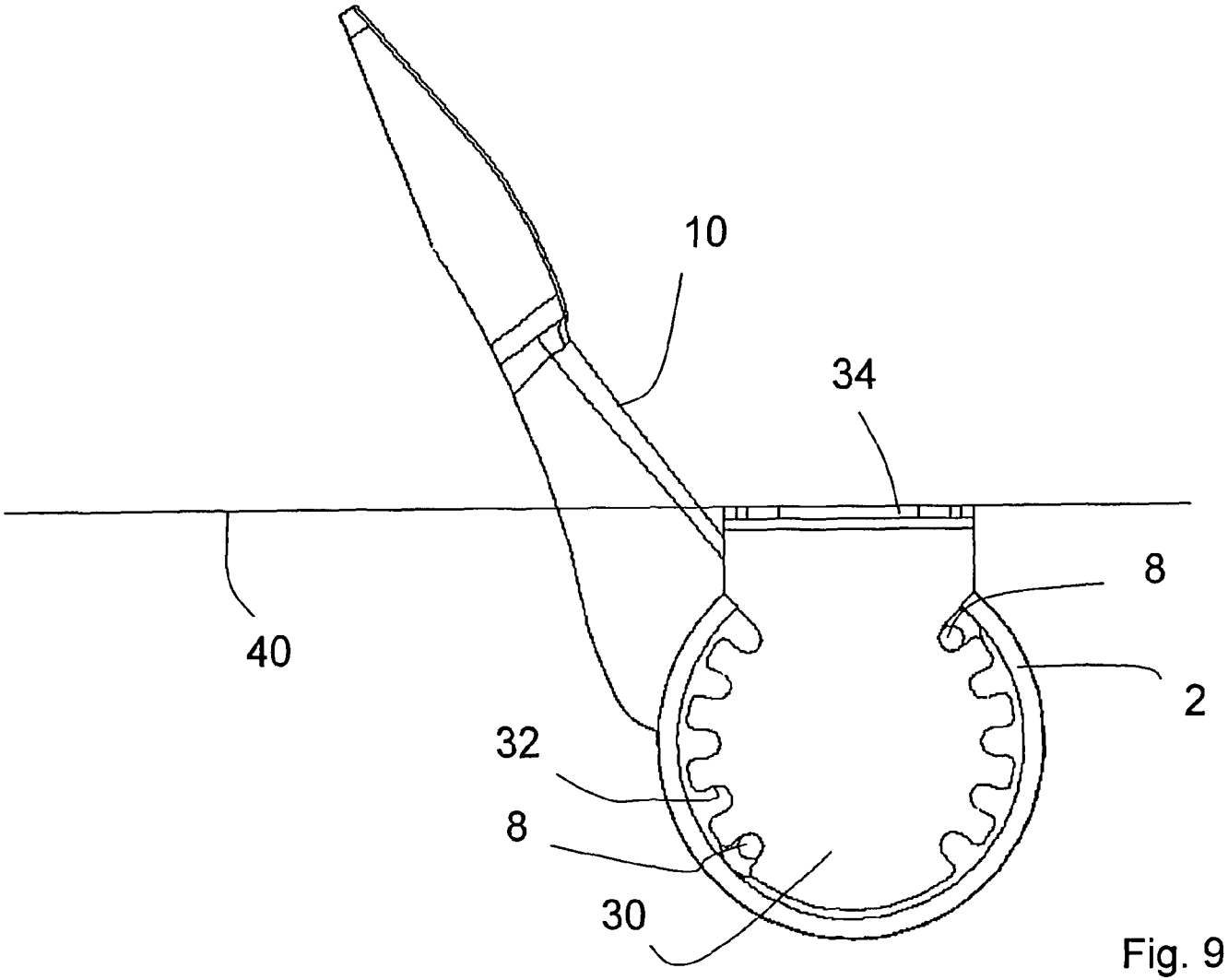

The invention will be further described with reference to a preferred embodiment in connection with the drawings, in which:

FIG. 1 shows an exploded view of an embodiment of the pedal assembly suitable for carrying out a method according to the invention, FIGS. 2 to 6 show subsequent states of the pedal assembly of the embodiment of FIG. 1 as perspective views, and FIGS. 7 to 9 show different mounting options of the first embodiment of the pedal assembly.

FIG. 1 shows an exploded view of various components of an exemplary pedal assembly suitable for carrying out a method according to the invention. The assembly comprises two housing parts 1 and 2 which, when fitted to each other provide a cylindrical bearing space therein. First, a cylindrical end portion 12 of the pedal lever 10 is received in a cylindrical bearing space 7 of the first housing part, for pivotal movement therein. The first housing part 1 comprises an opening in its outer cylindrical surface through which a pedal arm portion extending from the cylindrical end portion 12 extends. This opening in the cylindrical outer surface of the housing part allows the pivotal movement of the pedal lever 10. At one end of the opening an end or stop surface 6 is limiting the pivotal moving range of the pedal lever and defines a rest position of the pedal lever 10. Against this stop surface 6 the pedal lever 10 is urged by a spring mechanism to hold it in its rest position, or to return at to its rest position after it has been pressed down.

The cylindrical end portion 12 has openings on both of its end faces which open into recesses formed therein. In the recess facing the second housing part 2 a mounting body 14 is fixed to a central pin. The mounting body 14 is provided with a radially extending slot 15. The slot 15 of the mounting body 14 is arranged to receive the first end portions 20*a* and 21*a* of the two torsional coil springs.

The spring mechanism comprises two torsinal coil springs 20 and 21 in this embodiment. In principle, also a single torsinal coil spring could be utilized, but two springs are preferred for safety reasons. Each of the two coil springs 20 and 21 has an end portion projecting inwardly in radial direction and forming the first end portions 20*a* and 21*a* (see for example FIG. 2). The opposite end portions are designated 20*b* and 21*b*.

The second housing part 2 is smaller than the first housing part 1 and rather is a cover or lid for closing the first housing part 1 after insertion of the relevant components of the pedal assembly.

Also shown in FIG. 1 is a bracket 30 for fixing the housing 1, 2 in a vehicle cabin as will be explained in more details below.

In the following the method for assembling in this embodiment of will be explained in connection with FIGS. 2 to 6.

Figure 2:
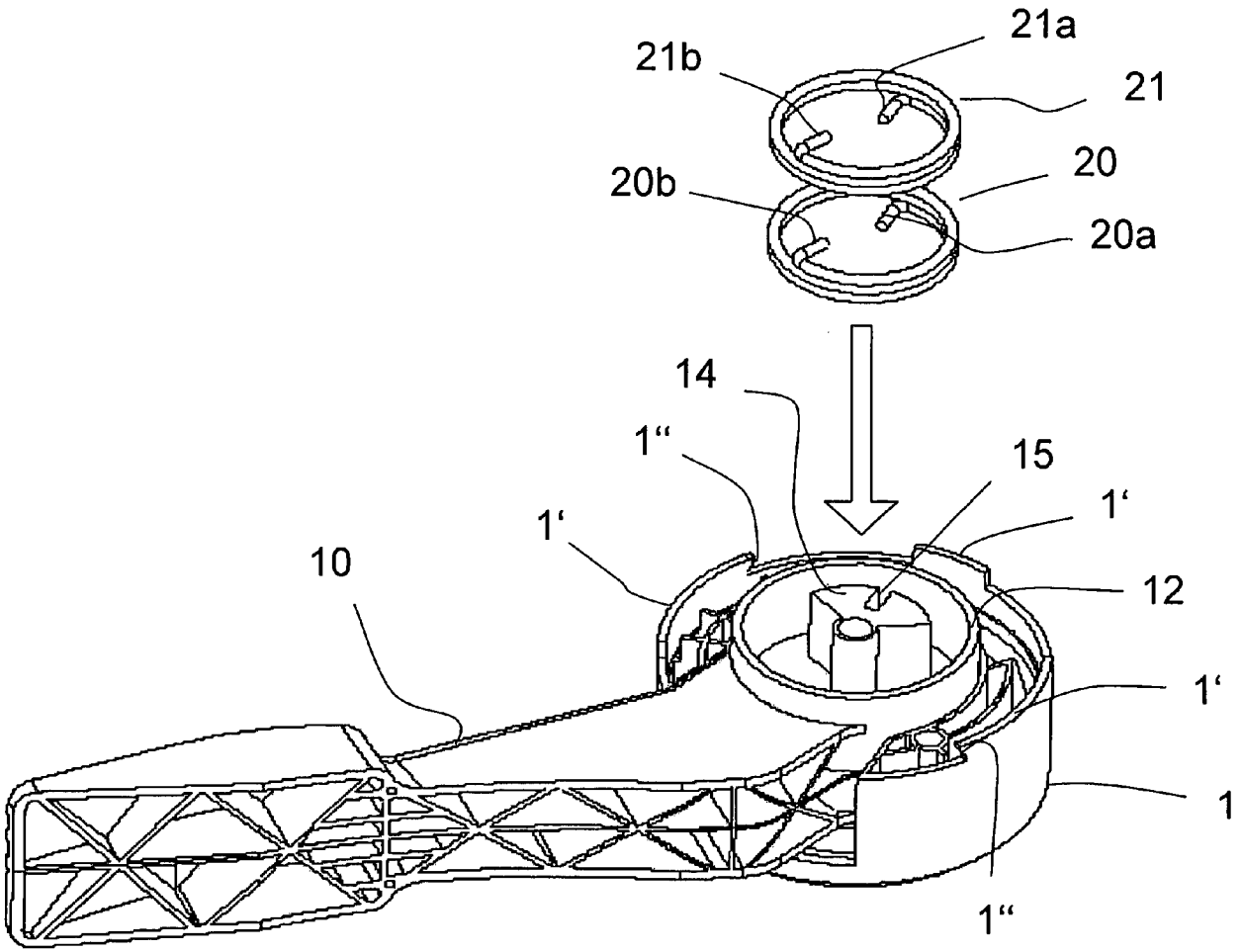

In FIG. 2 the pedal lever 10 has been inserted with its cylindrical end portion 12 into the part of the cylindrical bearing space 7 formed in the first housing part 1. Then the two torsional coil springs 20, 21 are inserted in the opening in the end face of the cylindrical end portion 12 and into the recess formed therein. This is done in such a manner that the radially inwardly projecting end portions 20*a* and 21*a* of the two coil springs 20 and 21 are inserted into the slot 15 of the mounting body 14 fixed in the recess of the cylindrical end portion 12.

Figure 3:
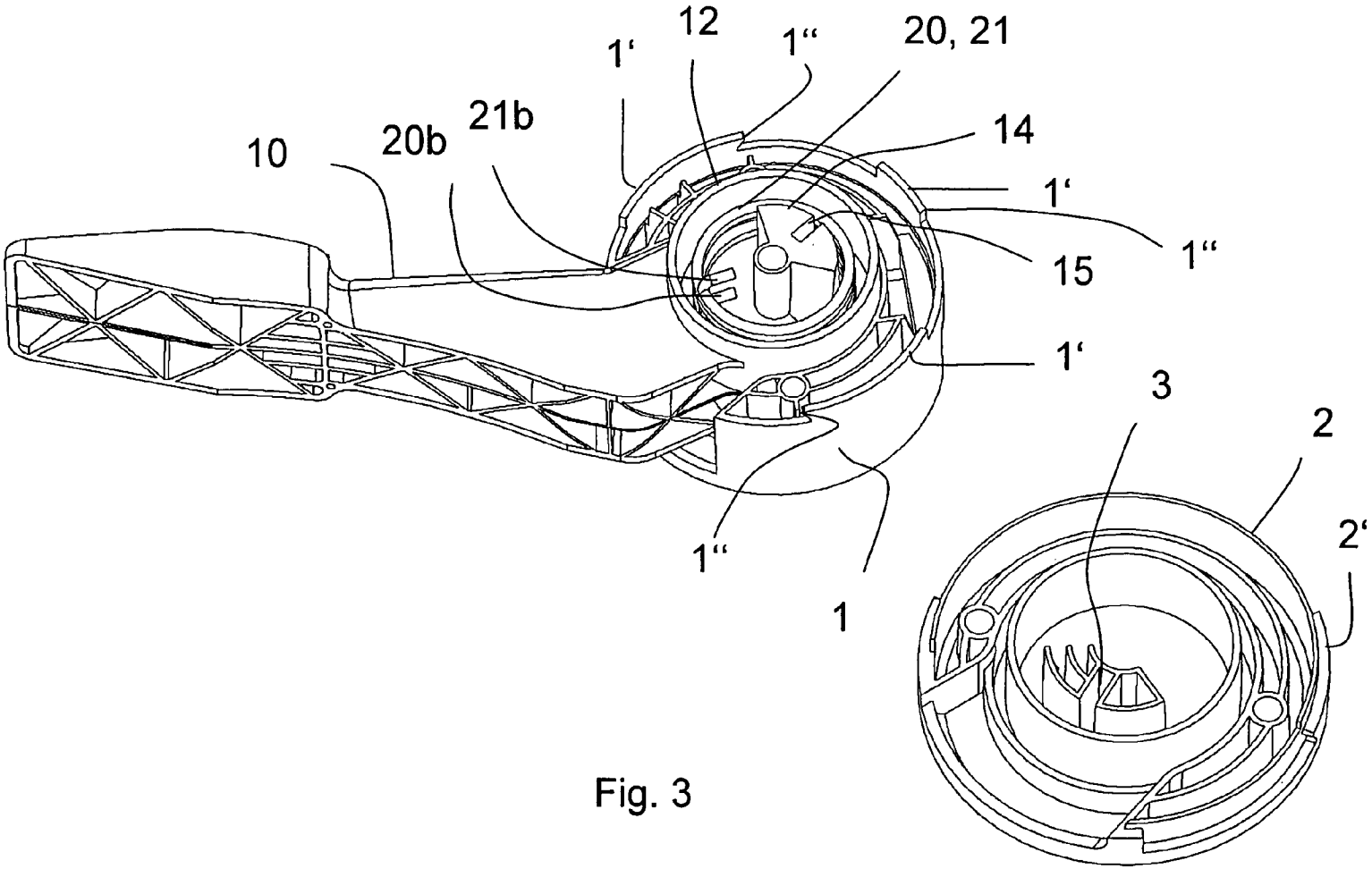
Figure 4:
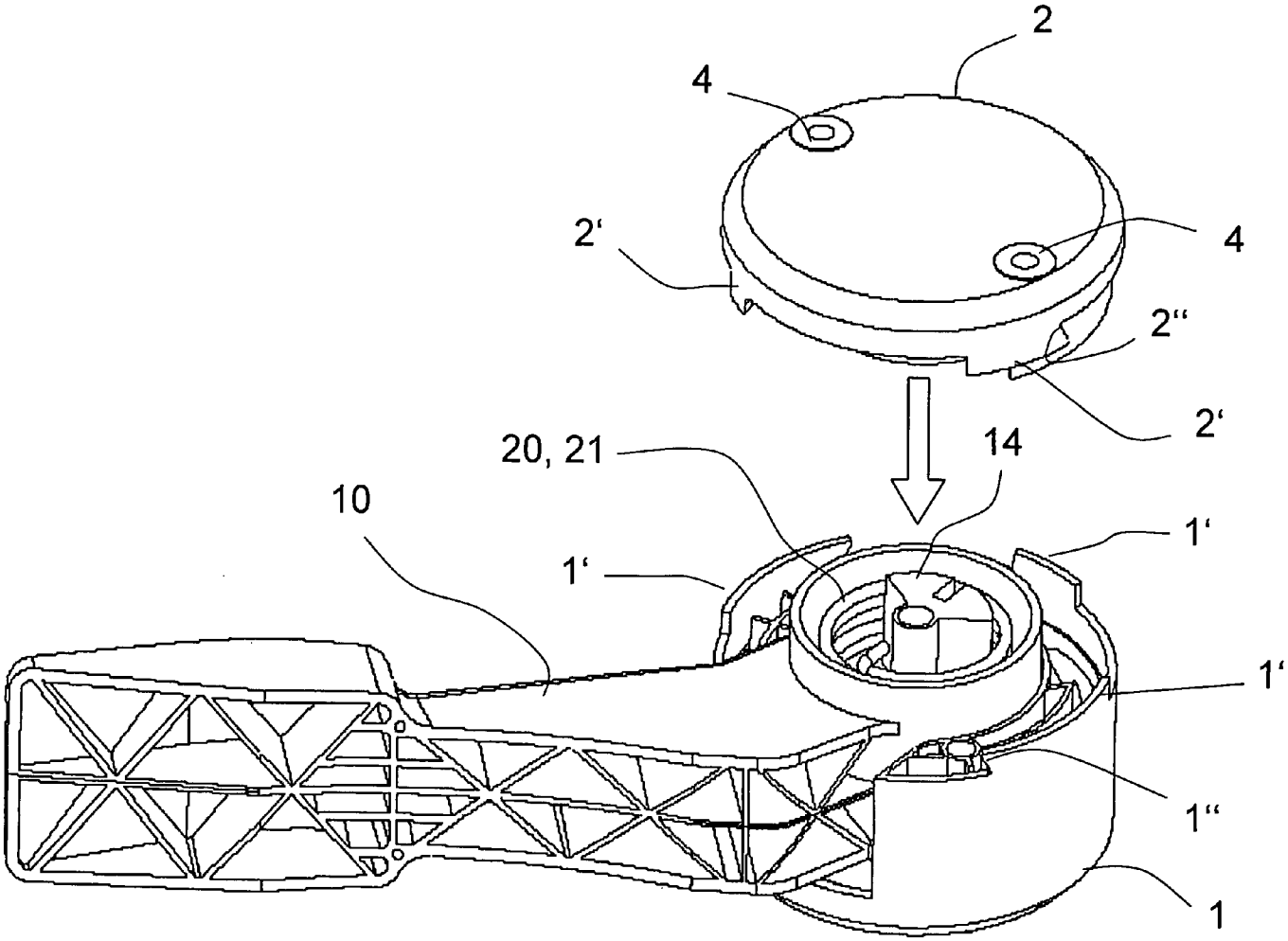

In FIG. 3 this assembly state is shown together with the inner wall structures of the second housing part 2. These inner wall structures include a remaining end portion 7' which, together with the portion 7 of the first housing part 1, provide the cylindrical bearing space to enclose the cylindrical end portion 12 of the pedal lever. Inside of this cylindrical portion a wall structure is provided in which a second radial slot 3 is formed for receiving the other end portions 21*a*, 21*b* of the two torsional coil springs 20, 21. The second housing part 2 is positioned on the first housing part 1 with the pedal lever 10 and the springs 20, 21 received therein in such a manner that the slot 3 of the second housing part is receiving the second end portions 20*b*, 21*b* of the two coil springs. This step is illustrated in FIG. 4.

Thereafter the second housing part 2 is rotated with respect to the first housing part 1 as shown in FIG. 5 in a direction such that the two coils springs 20, 21 are brought in a tensioned state in which the two coil springs exert a force on the pedal lever 10 which urges is to its rest position in abutment on the stop surface 6 of the first housing part 1.

As is also shown in FIGS. 2 to 6 the first and second housing parts 1 and 2 are provided with connection means in the form of projections 1' and 2' extending their walls in parts of the circumference of the housing parts. These projections 1' and 2' are dimensioned and located in a manner with respect to each other on the housing parts 1 and 2 such that they are complementary in the intended locked position of the first and second housing parts 1 and 2. In other words, in the intended locked position projections 1' are formed on the first housing part at locations where no projections 2' on the second housing part are formed and vice versa.

At least one of the projections 1' is formed on one of its edges as a sloping protrusion 1". This sloping protrusion is formed on the leading edge, which is leading when the second housing part 2 is rotated against the first housing part, due to the bias force of the spring mechanism. The corresponding projection 2' is formed with a mating, complementary sloping protrusion 2" facing the sloping protrusion 1" of the first housing part 1 in rotational direction.

This location and arrangement of the projections 1', 2' allows the following way of assembling the housing parts 1 and 2.

After the second housing part 2 has been lowered onto the first housing part 1, as shown in FIG. 4, in a position such that the radial slot 3 of the second housing part 2 received the other end portions 20*b*, 21*b* of the two torsional coil springs, the two housing parts 1 and 2 come into contact with each other. This contact is first taking place when the projections 1' of the first housing part 1 come into contact with the projections 2' of the second housing part 2 as shown in FIG. 5. At this stage the housing parts 1 and 2 are not yet in their intended rotational positioning with respect to each other and there is no tension in the spring mechanism. Therefore, and to bring the spring mechanism in a tensioned state to provide the desire bias force, the second housing part 2 is rotated in clockwise direction as indicated in FIG. 6 to a position where the projections 1' and 2' are no longer opposing each other. Then the second housing part 2 may be lowered further as indicated by the downward arrow in FIG. 6. Once the second housing part 2 has been fully lowered onto the first housing part 1 the bias force of the springs 20, 21 urges the second housing part 2 back in counter-clockwise direction which has the effect that the sloping protrusions 1" and 2" on the edges of the projections 1' and 2' come into mating engagement with each other. The bias force of the springs 20, 21 which urges the second housing part 2 back in counterclockwise direction is a consequence of the bias force exerted by the springs 20, 21 on the pedal lever 10 urging it in clockwise direction in abutment against the stop surface 6 in its rest position. In this way the bias force provided by the torsional coil springs 20, 21 is utilized for a second purpose besides the first purpose of biasing the pedal lever 10 to its rest position. The second purpose fulfilled is to hold the first and second housing parts in rotational engagement with respect to each other, without need of any further fastening means or any further components to be attached for holing the first and second housing parts 1 and 2 and the pedal lever in this pre-assembled state.

With reference to FIGS. 7 to 9 several mounting options of the pedal assembly according to the invention will now be described. The bracket 30 comprises a base portion adapted to be mounted to a housing part. The bracket 30 further has a projecting portion extending therefrom and comprising means 34 which allow fixing to a vehicle cabin structure. In the illustrated embodiment these means are formed by an angled end portion 34 which comprises two cut outs through which screws or bolts may be inserted and fixed at a vehicle cabin structure. In the illustrated embodiment the second housing part 2 comprises two threaded holes 4 which allow to apply screws. The base portion of the bracket 30 in turn is rotationally symmetric in the sense that it may be fixed with various angular orientations of the projecting portion of the bracket from the housing. For this purpose the base portion of the bracket 30 has a plurality of openings 32 arranged on the circumference of the base portion and being positioned such that a pair of diametrically opposing openings may be positioned aligned with the holes 4 in the second housing part 2. By screwing in two screws 8 through a selected pair of openings 32 into the treaded holes 4 of the second housing part 2 the bracket may be mounted on the housing with various angular orientations of the projecting part of the bracket with respect to the housing. Three examples of different orientations are shown in FIGS. 7 to 9.

In FIG. 7 the bracket is oriented such that it allows mounting of the pedal assembly on an upstanding structure 42 of the vehicle cabin, the floor of the vehicle cabin being indicated at 40.

In FIG. 8 the pedal assembly is again mounted on an upstanding structure 42 of the vehicle cabin, but with the screws fixed in a different pair of opposite openings 32 such that the bracket 30 has a different angular orientation with respect to the remaining parts of the pedal assembly; in this case the pedal lever 10 is extending with a smaller angle with respect to a horizontal line or the floor 40 compared to the orientation of FIG. 7.

In FIG. 9 a further mounting option is illustrated in which the bracket is mounted on the floor 40 from below, with the pedal arm 10 projecting from an opening in the floor 40.

In principle the bracket could also be located inside of the housing, for example inside of the second housing part 2. In this case a space for receiving the base portion of the bracket 30 has to be provided in the second housing part below its outer wall, and a slot has to be provided in the second housing part such that the projecting portion of the bracket may extend therethrough. The slot must have a sufficient angular extension such that the angular orientation of the projecting part of the bracket 30 may be varied to the desired extent. Otherwise the bracket 30 could be essentially the same as in the embodiment of FIGS. 7 to 9, wherein two screws 8 would then be inserted through the openings 4 in the second housing part, then extend through two openings 32 on the circumference of the base portion of the bracket and further into a threaded hole inside of the second housing part.

It should be understood that it is beneficial to choose the materials of the cylindrical end portion of the pedal and of the housings parts to be with regards to the materials friction coefficients in order to achieve an appropriate friction resistance which is lower than the friction resistance between parts of the same material.

The invention claimed is:

1. Method for assembling a pedal assembly for a motor vehicle, the method including the steps of:

pivotally mounting a pedal lever by inserting a cylindrical end portion of the pedal lever through an opening in a first housing part, the cylindrical end portion being at least partially received in a complementary shaped first cylindrical bearing space portion provided in the first housing part, which first housing part comprises a stop surface against which the pedal lever abuts in a rest position, providing a spring mechanism exerting a bias force on the pedal lever to urge the pedal lever to the rest position, applying a second housing part to close the opening of the first housing part, and connecting the first and second housing parts, wherein the spring mechanism includes:

a torsional coil spring attached with a first end portion thereof to the cylindrical end portion, and a second end portion of the torsional coil spring attached to the second housing part and the second housing part applied to the opening of the first housing part, the second housing part rotated with respect to the first housing part to establish a spring tension in the torsional coil spring which generates the bias force urging the pedal lever to the rest position against the stop surface, wherein the first and second housing parts are connected to maintain a tensioned state of the torsional coil spring.

2. The method for assembling a pedal assembly according to claim 1, wherein the step of connecting the first and second housing parts is further defined by rotating the second housing part with respect to the first housing part beyond a locking position in which the bias force is established by the spring tension of the torsional coil spring, wherein the first and second housing parts are moved further towards each other in a direction of an axis of rotational movement such that mating connection means on the first and second housing parts are located opposite to each other in a rotational direction, and allowing the first and second housing parts to rotate back biased by the bias force of the torsional coil spring such that the connection means come into mating engagement and are held in mating engagement in the locking position of the first and second housing parts by the bias force of the torsional coil spring.

3. The method for assembling a pedal assembly according to claim 1, wherein the step of connecting the first and second housing parts involves rotating the second housing part with respect to the first housing part to a locking position in which the bias force is established by the spring tension of the torsional coil spring, and moving the first and second housing parts further towards each other in a direction of an axis of rotational movement to bring latch projections on one of the housing parts into engagement with locking recesses on the other housing part to establish an interlocking engagement between the first and seconding housing parts.

4. The method for assembling a pedal assembly according to claim 1, wherein the step of connecting the first and second housing parts involves, rotating the second housing part with respect to the first housing part into the locking position in which the bias force is established by the spring tension of the torsional coil spring, and applying fasteners to connect the first and second housing parts against further rotating and movement along an axis of rotational movement.

5. The method for assembling a pedal assembly according to claim 1, wherein the spring mechanism further includes a bracket that comprises a base portion and a portion projecting from the base portion, the portion projecting from the base portion carrying at a remote end thereof a portion allowing to fix the bracket to a vehicle cabin structure, and wherein the method further includes the step of fixing the bracket to one of the housing parts in a rotational orientation of the portion projecting from the base portion with respect to the housing.

6. The method for assembling a pedal assembly according to claim 5, wherein the step of fixing the bracket to one of the housing parts involves placing the bracket at one of the housing parts and selecting two openings out of plurality of openings in the base portion of the bracket wherein the portion projecting from the base portion of the bracket is in the rotational orientation when the selected openings are in alignment with a pair of threaded holes provided in the housing parts, and wherein the method further includes the step of inserting two screws to extend through the selected openings and fixing the screws with respect to the housing parts by screwing the screws into the threaded holes.

7. The method for assembling a pedal assembly according to claim 5, wherein the base portion of the bracket includes a plurality of openings and each of the first and second housing parts includes a pair threaded holes, and wherein the step of fixing the bracket to one of the housing parts involves:

positioning the bracket such that two of the openings of the base portion of the bracket are aligned with respective threaded holes of one of the housing parts; and inserting a screw through each of the two openings and the respective threaded holes.

8. The method for assembling a pedal assembly according to claim 7, wherein during the step of positioning, the portion projecting from the base portion of the bracket is in the rotational orientation.

9. The method for assembling a pedal assembly according to claim 1, wherein the step of connecting the first and second housing parts is further defined by rotating the second housing part with respect to the first housing part beyond a locking position in which the bias force is established by the tension of the torsional coil spring, wherein the first and second housing parts are moved further towards each other in a direction of an axis of rotational movement such that a first projection on the first housing part and a complementary second projection of the second housing part are located opposite to each other in a rotational direction, and allowing the first and second housing parts to rotate back biased by the bias force of the torsional coil spring such that the first and second projections come into mating engagement and are held in mating engagement in the locking position of the first and second housing parts by the bias force of the torsional coil spring.

10. The method for assembling a pedal assembly according to claim 1, wherein the step of connecting the first and second housing parts is further defined by rotating the second housing part with respect to the first housing part beyond a locking position in which the bias force is established by the tension of the torsional coil spring, wherein the first and second housing parts are moved further towards each other in a direction of an axis of rotational movement such that a sloping protrusion of a first projection formed on an edge of the first housing part and a complementary sloping protrusion of a second projection formed on an edge of the second housing part are located such that the sloping protrusion of the first projection and the complementary sloping protrusion of the second projection face one another in the rotational direction, and allowing the first and second housing parts to rotate back biased by the bias force of the torsional coil spring such that the sloping protrusion of the first projection and the complementary sloping protrusion of the second projection come into mating engagement and are held in mating engagement in the locking position of the first and second housing parts by the bias force of the torsional coil spring.

* * * * *